US005504493A

United States Patent [19]

Hirshfield

[11] Patent Number: 5,504,493

[45] Date of Patent: Apr. 2, 1996

[54] ACTIVE TRANSMIT PHASED ARRAY ANTENNA WITH AMPLITUDE TAPER

[75] Inventor: Edward Hirshfield, Cupertino, Calif.

[73] Assignee: Globalstar L.P., San Jose, Calif.

[21] Appl. No.: 437,931

[22] Filed: May 9, 1995

Related U.S. Application Data

[63] Continuation of Ser. No. 189,111, Jan. 31, 1994, abandoned.

[51] Int. Cl.[6] ..... H01Q 3/22; H01Q 3/24; H01Q 3/26

[52] U.S. Cl. ..... 342/372; 342/365

[58] Field of Search ..... 342/372, 361, 342/362, 363, 364, 365, 366, 373

[56] References Cited

U.S. PATENT DOCUMENTS

| | | | |
|---|---|---|---|
| 2,967,301 | 1/1961 | Rearwin | 343/771 |
| 3,423,756 | 1/1969 | Foldes | 343/755 |
| 3,546,699 | 12/1970 | Smith | 343/100 |
| 3,725,929 | 4/1973 | Spanos . | |
| 3,725,943 | 4/1973 | Spanos . | |
| 3,969,729 | 7/1976 | Nemit | 343/756 |
| 4,041,501 | 8/1977 | Frazita et al. | 343/844 |
| 4,099,181 | 7/1978 | Scillieri et al. | 343/16 M |
| 4,595,926 | 6/1986 | Kobus et al. | 343/368 |
| 4,797,682 | 1/1989 | Klimczak | 343/844 |
| 4,973,972 | 11/1990 | Huang | 343/829 |
| 5,038,146 | 8/1991 | Troychak et al. | 342/372 |
| 5,043,738 | 8/1991 | Shapiro et al. | 343/829 |
| 5,093,667 | 3/1992 | Andricos | 342/372 |
| 5,283,587 | 2/1994 | Hirshfield et al. | 342/372 |
| 5,304,999 | 4/1994 | Roberts et al. | 343/778 |
| 5,343,211 | 8/1994 | Kott | 342/379 |
| 5,389,939 | 2/1995 | Tang et al. | 343/754 |

FOREIGN PATENT DOCUMENTS

| | | |
|---|---|---|
| 0513856 | 11/1992 | European Pat. Off. . |
| 0600715 | 6/1994 | European Pat. Off. . |
| 2238176 | 5/1991 | United Kingdom . |
| WO88/01106 | 2/1988 | WIPO . |

OTHER PUBLICATIONS

"Statistically Thinned Arrays with Quantized Element Weights" Robert J. Mailloux, Edward Cohen, IEEE Transactions on Antennas and Propagation, Apr. 1991, vol. 39, No. 4, US.

*Primary Examiner*—Theodore M. Blum
*Attorney, Agent, or Firm*—Perman & Green

[57] ABSTRACT

A phase array transmitting antenna system, including a plurality of radiating elements, each radiating element is capable of transmitting radiation. One or more constant phase and amplitude amplifiers are affixed to the radiating element in the array, wherein each radiating element is capable of producing radiation of a substantially uniform phase as the other radiating elements in the array, but distinct amplitudes according to patterns which simplify implementation.

11 Claims, 3 Drawing Sheets

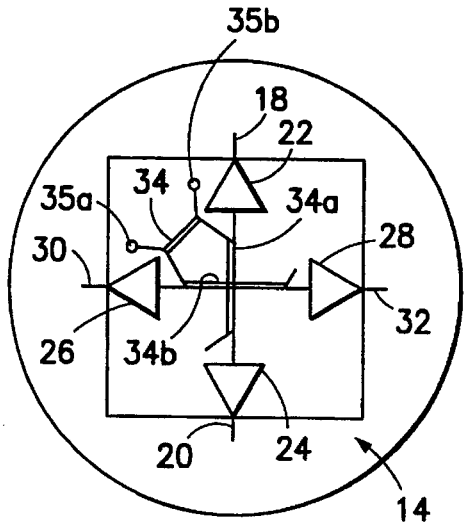
FIG. 3
PRIOR ART
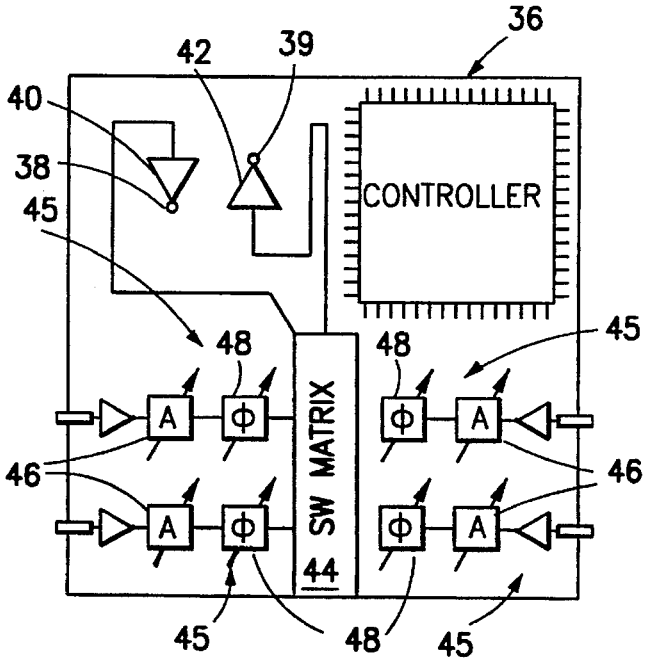
FIG. 4
PRIOR ART
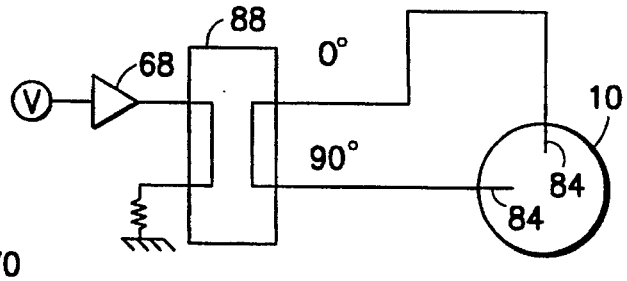
FIG. 6
FIG. 5
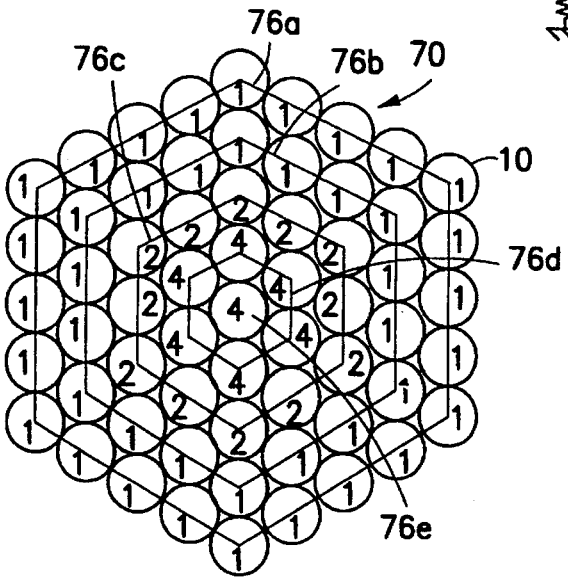

ACTIVE TRANSMIT PHASED ARRAY ANTENNA WITH AMPLITUDE TAPER

This is a continuation of application Ser. No. 08/189,111 filed on Jan. 31, 1994, now abandoned.

FIELD OF THE INVENTION

The present invention relates to microwave antenna systems and more particularly to phased array antenna systems of the type which generate multiple simultaneous antenna beams by controlling the relative phase of signals in multiple radiating elements, and in which the amplitude is controlled by applying the effects of different numbers of phased amplifiers to each of the radiating elements.

BACKGROUND OF THE INVENTION

For many years radar system array antennas have been known, and have been used for the formation of sharply directive beams. Array antenna characteristics are determined by the geometric position of the radiator elements and the amplitude and phase of their individual excitations.

Later radar developments, such as the magnetron and other high powered microwave transmitters, had the effect of pushing the commonly used radar frequencies upward. At those higher frequencies, simpler antennas became practical which usually included shaped (parabolic) reflectors illuminated by horn feed or other simple primary antenna.

Next, electronic (inertialess) scanning became important for a number of reasons, including scanning speed and the capability for random or programmed beam pointing. Since the development of electronically controlled phase shifters and switches, attention in antenna design has been directed toward the array type antenna in which each radiating element can be individually electronically controlled. Controllable phase shifting devices in the phased array art provides the capability for rapidly and accurately switching beams and thus permits a radar to perform multiple functions interlaced in time, or even simultaneously. An electronically steered array radar may track a great multiplicity of targets, illuminate and/or tag a number of targets, perform wide-angle search with automatic target selection to enable selected target tracking and act as a communication system directing high gain beams toward distant receivers and/or transmitters. Accordingly, the importance of the phase scanned array is great. The text "Radar Handbook" by Merrill I. Skolnik, McGraw Hill (1970) provides a relatively current general background in respect to the subject of array antennas in general.

Other references which provide general background in the art include:

U.S. Pat. No. 2,967,301 issued Jan. 3, 1961 to Rearwin entitled, SELECTIVE DIRECTIONAL SLOTTED WAVEGUIDE ANTENNA describes a method for creating sequential beams for determining aircraft velocity relative to ground.

U.S. Pat. No. 3,423,756 issued Jan. 21, 1969, to Foldes, entitled SCANNING ANTENNA FEED describes a system wherein an electronically controlled conical scanning antenna feed is provided by an oversized waveguide having four tuned cavities mounted about the waveguide and coupled to it. The signal of the frequency to which these cavities are tuned is split into higher order modes thus resulting in the movement of the radiation phase center from the center of the antenna aperture. By tuning the four cavities in sequence to the frequency of this signal, it is conically scanned. Signals at other frequencies, if sufficiently separated from the frequency to which the cavities are tuned, continue to propagate through the waveguide without any disturbance in the waveguide.

U.S. Pat. No. 3,969,729, issued Jul. 13, 1976 to Nemet, entitled NETWORK-FED PHASED ARRAY ANTENNA SYSTEM WITH INTRINSIC RF PHASE SHIFT CAPABILITY discloses an integral element/phase shifter for use in a phase scanned array. A non-resonant waveguide or stripline type transmission line series force feeds the elements of an array. Four RF diodes are arranged in connection within the slots of a symmetrical slot pattern in the outer conductive wall of the transmission line to vary the coupling therefrom through the slots to the aperture of each individual antenna element. Each diode thus controls the contribution of energy from each of the slots, at a corresponding phase, to the individual element aperture and thus determines the net phase of the said aperture.

U.S. Pat. No. 4,041,501 issued, Aug. 9, 1977 to Frazeta et al., entitled LIMITED SCAN ARRAYANTENNA SYSTEMS WITH SHARP CUTOFF OF ELEMENT PATTERN discloses array antenna systems wherein the effective element pattern is modified by means of coupling circuits to closely conform to the ideal element pattern required for radiating the antenna beam within a selected angular region of space. Use of the coupling circuits in the embodiment of a scanning beam antenna significantly reduces the number of phase shifters required.

U.S. Pat. No. 4,099,181, issued Jul. 4, 1978, to Scillieri et al, entitled FLAT RADAR ANTENNA discloses a flat radar antenna for radar apparatus comprising a plurality of aligned radiating elements disposed in parallel rows, in which the quantity of energy flowing between each one of said elements and the radar apparatus can be adjusted, characterized in that said radiating elements are waveguides with coplanar radiating faces, said waveguides being grouped according to four quadrants, each one of said quadrants being connected with the radar apparatus by means of a feed device adapted to take on one or two conditions, one in which it feeds all the waveguides in the quadrant and the other in which it feeds only the rows nearest to the center of the antenna excluding the other waveguides in the quadrant, means being provided for the four feed devices to take on at the same time the same condition, so that the radar antenna emits a radar beam which is symmetrical relatively to the center of the antenna, and having a different configuration according to the condition of the feed devices.

U.S. Pat. No. 4,595,926, issued Jun. 17, 1986 to Kobus et al. entitled DUAL SPACE FED PARALLEL PLATE LENS ANTENNA BEAMFORMING SYSTEM describes a beamforming system for a linear phased array antenna system which can be used in a nonpulse transceiver, comprising a pair of series connected parallel plate constrained unfocused lenses which provide a suitable amplitude taper for the linear array to yield a low sidelobe radiation pattern. Digital phase shifters are used for beam steering purposes and the unfocused lenses de-correlate the quantization errors caused by the use of such phase shifters.

U.S. Pat. No. 3,546,699, issued Dec. 8, 1970 to Smith, entitled SCANNING ANTENNA SYSTEM discloses a scanning antenna system comprising a fixed array of separate sources of in-phase electromagnetic energy arranged in the arc of a circle, a transducer having an arcuate input contour matching and adjacent to the arc, a linear output contour, and transmission properties such that all of the output energy radiated by the transducer is in phase, and means for rotating the transducer in the plane of the circle about the center of the circle.

U.S. Pat. No. 5,283,587, issued Feb. 1, 1994 to Hirshfield et al. entitled ACTIVE TRANSMIT PHASED ARRAY ANTENNA discloses an antenna for generating multiple independent simultaneous antenna beams to illuminate desired regions while not illuminating other regions. The size and shape of the regions is a function of the size and number of elements populating the array and the number of beams is a function of the number of beam forming networks feeding the array. All the elements of the array are operated at the same amplitude level and beam shapes and directions are determined by the phase settings. There is no indication of how to achieve an amplitude taper in this system. In some applications, phase only taper is insufficient to achieve necessary beam shapes and suppress sidelobes.

It would be desirable to be able to provide an antenna array where each of the amplifiers are provided with nearly identical output characteristics to limit the adverse phase effects resulting from devices with differing internal structures, while permitting an effective tapering of both amplitude and phase for each of the elements in the array.

SUMMARY OF THE INVENTION

The present invention relates to a phase array transmitting antenna system which includes a plurality of radiating elements, each radiating element is capable of transmitting radiation. One or more constant phase and amplitude amplifiers are affixed to the radiating element in the array, wherein each radiating element is capable of producing radiation of a substantially uniformphase as the other radiating elements in the array, but distinct amplitudes.

BRIEF DESCRIPTION OF THE DRAWINGS

FIG. 3 is a schematic top view of the air dielectric cavity shown in FIG. 2;

FIG. 4 is a bottom schematic view of the controller used in FIG. 2;

FIG. 5 is a front view of a present invention embodiment of a plurality of arrayed elements for an active transmit phased array antenna;

FIG. 6 illustrates one embodiment of a driving portion of the present invention in which an antenna element (10) is driven by a single amplifier (68);

DETAILED DESCRIPTION OF THE PRESENT INVENTION

Phase Only Control

Figure 1:
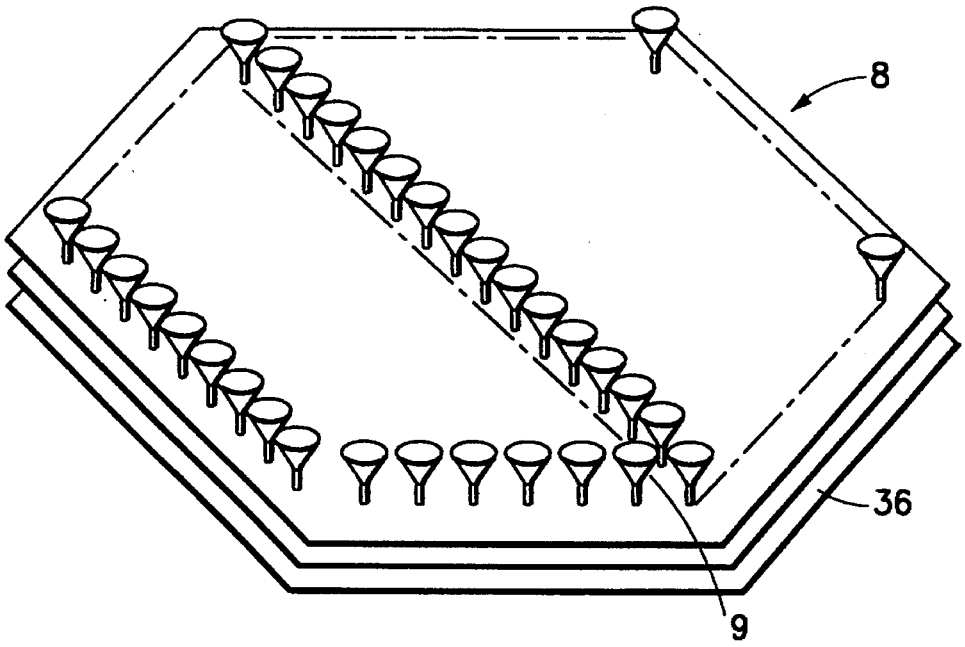
FIG. 1 PRIOR ART
FIG. 1 is a perspective view of an embodiment of a plurality of arrayed elements for an active transmit phased array antenna.
Figure 2:
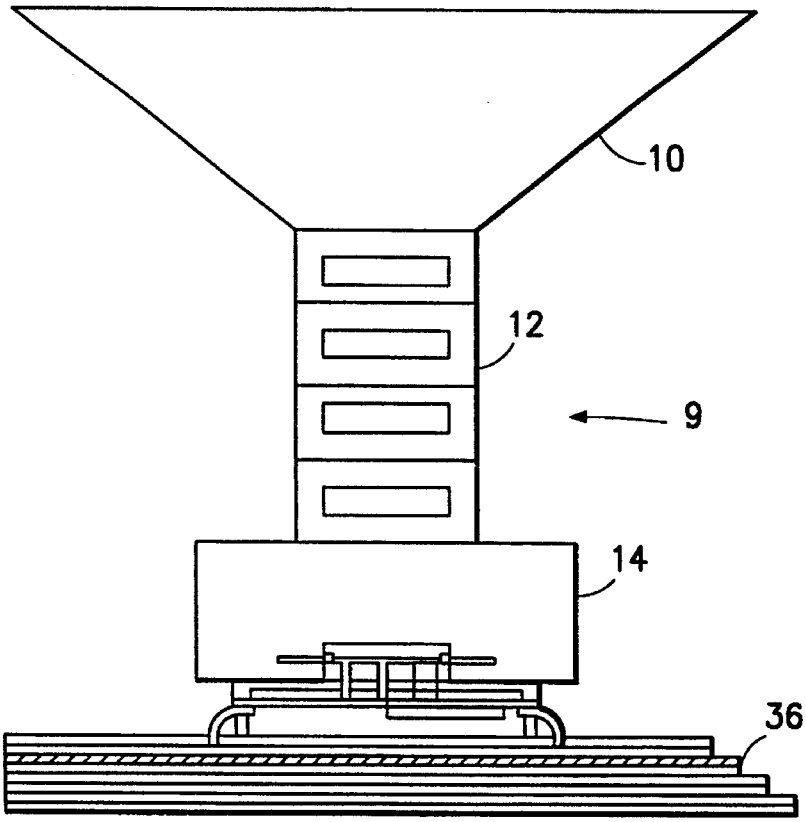
FIG. 2 PRIOR ART
FIG. 2 is a schematic illustration of an embodiment of a cross-sectional view of an element of the plurality of the type employed in the multi-element phased array antenna of FIG. 1.

Referring to FIG. 1, a version of an active transmit phased array antenna 8 is shown including an illustrative number of the 213 units 9 disposed in a hexiform configuration, as illustrated in U.S. Pat. No. 5,283,587, which issued Feb. 1, 1994 to Hirshfield et al. (incorporated herein by reference). FIG. 2 illustrates a single unit 9 included in the FIG. 1 antenna 8. Each unit 9 of FIG. 1 is identical to that shown in FIG. 2 and includes a radiating element 10 (typically a horn or a patch antenna) capable of radiating in each of two orthogonal polarization planes with isolation of 25 dB or greater. The radiating element is fed by a multi-pole band-pass filter means 12 whose function is to pass energy in the desired band and reject energy at other frequencies. This is of particular importance when the transmit antenna of the present invention is employed as part of a communication satellite that also employs receiving antenna(s) because spurious energy from the transmitter in the receive band could otherwise saturate and interfere with the sensitive receiving elements in the receiving antenna(s). In the FIG. 2 embodiment, the filter means 12 includes a series of sequentially coupled resonant cavities configured to maintain the high degree of orthogonality necessary to maintain the isolation referred to above.

The filter means 12 is coupled into an air dielectric cavity 14 mounted on a substrate 36. Air dielectric cavity 14 contains highly efficient monolithic amplifiers which excite orthogonal microwave energy in a push-pull configuration. Referring to FIG. 3, which is a schematic plan view of the air dielectric cavity 14 of FIG. 2, this excitation is accomplished by probes 18, 20, 30 and 32 which are mounted in combination with respective amplifiers 22, 24, 26 and 28. In FIG. 3, the probes 18 and 20 are placed such that they drive the cavity 14 at relative positions 180° apart such that their signals combine constructively when applied to the radiating element 10. This provides the transformation necessary to afford the push pull function when amplifiers 22 and 24 are driven out-of-phase. Amplifiers 26 and 28 similarly feed probes 30 and 32 which are 180° apart and are positioned at 90° from probes 18 and 20, such that they may excite orthogonal microwave energy in the cavity. The two pairs of amplifiers are fed in phase quadrature by hybrid input 34 via 180 degree couplers 34A and 34B to create circular polarization.

In order to accomplish the exact phase and amplitude uniformity necessary for orthogonal beams, amplifiers 22, 24, 26, and 28 must be virtually identical. The only practical way to enable this identity is to utilize monolithic microwave integrated circuits (MMIC), or a similar technology in constructing the amplifiers.

The 90° hybrid 34 is shown terminating in two dots 35*a*, 35*b* in FIG. 3. These dots represent feed through connections from the substrate 36 illustrated in the bottom view of FIG. 4, and the other ends of the feed through connections can be seen at location 38 and 39. One of these excites right circular polarization while the other excites left circular polarization. Additionally, if the signals passing through the feed through connections were fed directly to 180° couplers 34A and 34B without the benefit of the 90° hybrid 34, linearly polarized beams rather than circularly polarized beams would be excited. The hybrid 34 is fed through connectors 38 and 39 by MMIC driver amplifiers 40 and 42, one for each sense of polarization. The desired polarization for each beam is selected by switch matrix 44, which also combine all the signals for each polarization to feed the two driver amplifiers 40 and 42. Each beam input 45 (there are four in FIG. 4) includes an electronically controlled phase shifter 48 and attenuator 46 used to establish the beam direction and shape (size of each beam). All elements in the array are driven at the same level for any given beam. This is different from other transmit phased arrays, which use amplitude gradients across the array to reduce beam sidelobes.

The active transmit phased array antenna disclosed in the Hirshfield et al. patent employs uniform illumination (no gradient) in order to maximize the power efficiency of the antenna. Otherwise, the power capacity of an antenna element is not fully utilized. The total available power can be arbitrarily distributed among the set of beams with no loss of power. Once the power allocation for a given beam has been set on all elements of the antenna by setting the attenuators 46, then the phase (which is most likely different for every element) is set employing phase shifters 48 to establish the beam directions and shapes. The phase settings for a desired beam shape and direction are chosen by a process of synthesizing the beam. The synthesis process is an iterative, computation-intensive procedure, which can be performed by a computer. The objective of the synthesis process is to form a beam which most efficiently illuminates the desired region without illuminating the undesired regions. The region could be described by a regular polygon and the minimum size of any side will be set by a selected number of elements in the array and their spacing. In general, the more elements in the array, the more complex the shape of the polygon that may be synthesized. The process of phase-only beam shaping generates the desired beam shape but also generates grating lobes. Another objective of this invention, as used for a satellite antenna, is to minimize the relative magnitude of the grating lobes and to prevent them from appearing on the surface of the earth as seen from the satellite orbital position so that they will not appear as interference in an adjacent beam or waste power by transmitting it to an undesired location. The synthesis process minimizes the grating lobes, and it may also be used to generate a beam null at the location of a grating lobe that cannot otherwise be minimized to an acceptable level.

Phase and Amplitude Control

The number of independent beams that can be generated by the active transmit phase array antenna is limited only by the number of phase shifters 48 and attenuators 46 feeding each element. In the FIG. 1 to 4 embodiment, phase only considerations are utilized to achieve desired beam shapes.

Classical antenna theory suggest that better control of antenna side lobes and beam shapes can be achieved using both phase and amplitude taper. However, when the phase array is used for the transmission of power, and amplifiers (typically solid state power amplifiers) are employed, then it is important that all of the amplifiers incorporated in the array track one another in both amplitude and phase transfer characteristics.

The simplest and best way to achieve similar phase and amplitude characteristics is to make all of the amplifiers identical. This uniformity of characteristics is admirably accomplished by using amplifiers utilizing some technique capable of producing reliably similar amplitudes such as MMIC technology, as is well known. Once all of the amplifiers are formed nearly identically, it is also essential that they be driven nearly identically as well. This is necessary because the transfer characteristics of the amplifiers will change with altering drive levels. If some of the amplifiers are driven at a higher load than others, then the transfer characteristics of the amplifiers 68 would diverge and distortion of the electromagnetic radiation patterns produced by the antennas would result.

FIG. 5 is a front view of an illustrative array for a phase type antenna 70 with each circle representing a radiating element 10, and the number of amplifiers applied to each of the radiating elements 10 represents the amplitude of the signal applied by that radiating element. The lowest amplitude in the FIG. 5 configuration is 1. The only amplitudes illustrated are 1, 2, and 4 (which are all integer multiples of the lowest amplitude 1). FIG. 5 illustrates a hexagonal array (since each element has 6 nearest neighbor elements). The taper increment is 1,1,2,4,4 indicating that each element in the outermost ring **76*a* has an amplitude of 1, the adjacent rings 76*b*, 76*c*, 76*d* and 76*e* have elements with an amplitude of 1, 2, 4, and finally 4, respectively. While the particular taper configuration 1,1,2,4,4 is illustrated in the FIG. 5** embodiment, any desired taper may be produced using the teachings illustrated below.

There are two embodiments which provide the capabilities of controlling the taper of an antenna array resulting in the configuration illustrated in FIG. 5, or some other similar configuration. The first embodiment is referred to as the hybrid configuration while the second array is referred to as the parallel configuration.

Hybrid Configuration

Figure 7:
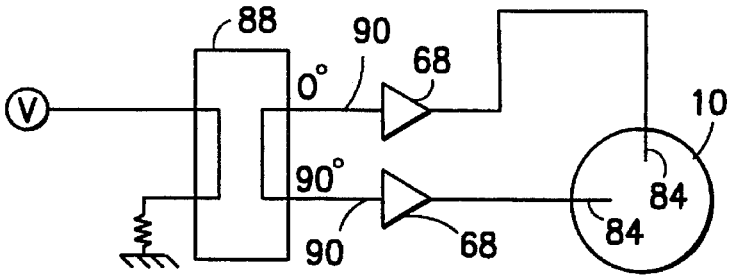
FIG. 7 illustrates an alternate driving portion of the present invention in which an antenna element (10) is driven by two amplifiers.
Figure 8:
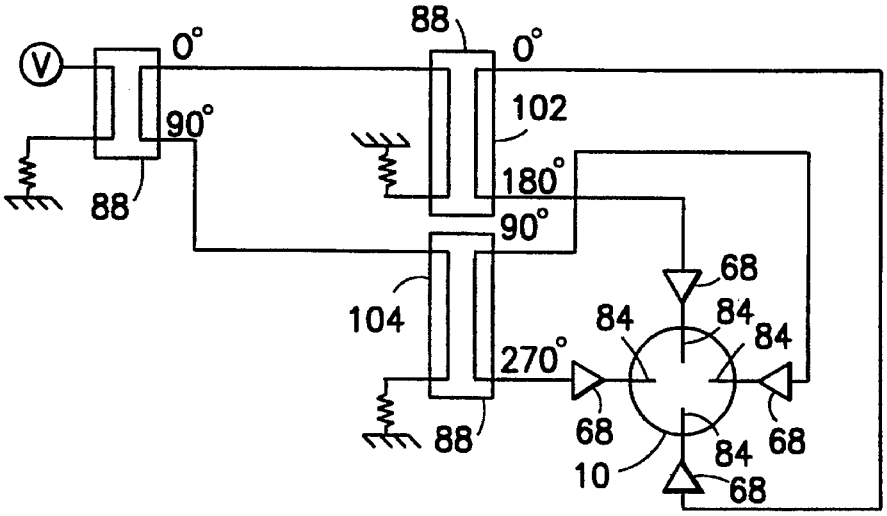
FIG. 8 illustrates yet another embodiment of a driving portion of the present invention, in which an antenna element (10) is driven by four amplifiers.

FIGS. 6 to 8 illustrate several distinct driving configurations which may be utilized to produce the FIG. 5 taper (or any other array of taper utilizing either 1, 2, or 4 amplifiers affixed to each of the radiating elements 10) in which the taper is optimally selected. Both phase and amplitude characteristics of the tapered output must be considered. Any integer multiple of the lowest power applied to any amplifier for each of the amplifiers may be provided in the tapered antenna array.

FIGS. 6–8 illustrate driving portions for radiating elements 10 in which recombination of the signals can be achieved in the manner in which power from one or more amplifier(s) 68 are coupled to one radiating element 10. Specifically, when the output of one amplifier 68 is applied to a 90 degree hybrid 88 (a 90 degree hybrid is a phase divider in which the two output signals are of substantially equal amplitude, and their phase is separated by 90 degrees), and the 90 degree hybrid 88 is used to drive radiating element 10 as is the case in FIG. 6; the output of the 90 degree hybrid is coupled to the radiating element 10 by two probes 84 mounted in proximity to the radiating element 10. This configuration will produce a wave front which is in phase and in geometric quadrature to achieve the sense of circular polarization (in this case a TE11 configuration). The term "radiating element", as used through this disclosure, is meant to apply to any horn antenna, patch antenna, or other device which is capable of emitting radiation.

When two amplifiers are used to drive a single radiating element as is the case in FIG. 7, then one of the two amplifiers can each be connected directly in series with one of the probes 84. Phase quadrature may be achieved by the use of a 90 degree hybrid 88, as previously described with reference to FIG. 4. The two outputs of the 90 degree hybrid 88 is connected to an input 90 of each of the amplifiers 68.

This configuration will produce twice the power applied to the radiating element of the FIG. 6 configuration.

FIG. 8 illustrates an increase in the number of amplifiers used to drive the radiating element 10 to four, resulting in four times the power output of the FIG. 6 embodiment. Four probes 84 are mounted at 90 degree increments about the periphery of the radiating element (which preferably has a circular or rectangular configuration). In order to accomplish, the signal must be altered by 90 degrees at each of the adjacent probes, in order to build a circular wave front constructively which will propagate into free space. This is accomplished by using one 90 and two 180 degree hybrids 100, 102,104. The two outputs of the first 90 degree hybrid 100 are input into the input of each of the 180 degree hybrids 102, 104 as illustrated in FIG. 8. There are outputs of the two 180 degree hybrids 102, 104 which are at 0 and 180, and 90 and 270 degrees, respectively as they are affixed about the outer periphery of the radiating element 10. In this manner, the circular wave front can be constructively formed within the radiating element 10. Note that while the term "circular wave front" is used through this disclosure, it is also possible to provide an elliptical wave front by controlling the relative signal strengths applied to each of the probes. Elliptical wave fronts are intended to be included within the definition of circular wave fronts as used within the present invention.

Parallel Configuration

Figure 9:
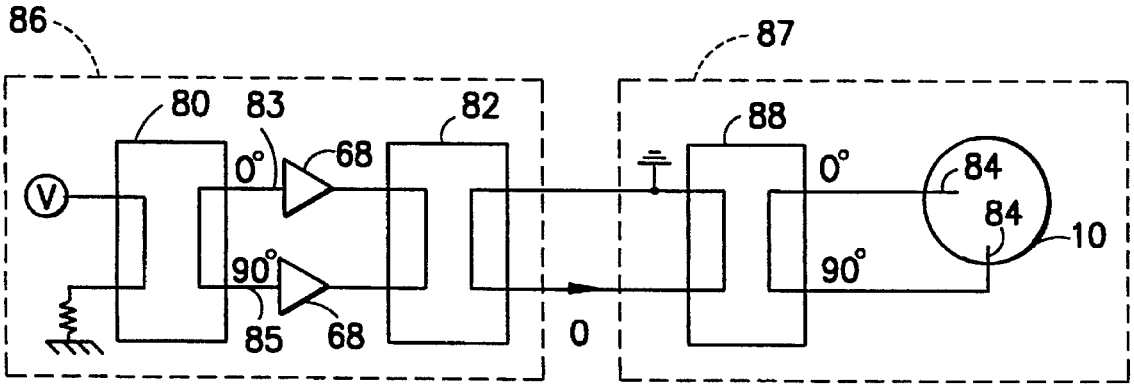
FIG. 9 illustrates a final alternate embodiment of a driving portion of the present invention in which an antenna element is driven by an undetermined number n of amplifiers (in this case n=2).

In the hybrid configuration of the present invention (FIGS. 6 to 8) described in the prior section, either 1, 2 or 4 amplifiers directly drive a radiating element using 90 and 180 degree hybrids, thereby producing a phase shift which accomplishes a desired taper. While this configuration may be among the simplest to construct and comprehend, it is also within the scope of the present invention that an alternate embodiment of the present invention may be used to produce a taper. Any integer (n) number of substantially identical amplifiers are driven in parallel by a power splitter device, with the outputs of the amplifiers coupled to a power combiner. Any number of amplifiers could be used as long as the number n is coupled with the proper amount of phase shift (360/n). An example of this configuration is illustrated in FIG. 9 which is referred to as the parallel configuration. The single output signal of the power combiner is applied to a 90 degree hybrid to produce the desired circular polarization.

The phrase "n elements in parallel" is defined to mean that each of the n elements are driven to the same amplitude, by having the power divider divide the total input power to be applied to all of the amplifiers being applied to each radiating element by the number of amplifiers n; and passing 1/n of the total power through each of the amplifiers 68; and then recombining the power in a n-way low loss power combiner, such that n times the power of each amplifier 68 is produced at the output of the power combiner as would be produced by a single amplifier.

In FIG. 9, low loss power splitters 80 (which are typically 90 degree hybrids) and power combiners 82 (which are the reversed 90 degree hybrids from the power splitters 80) are employed. The relative phase of each amplifier path 83, 85 is matched so that the signals which have undergone power recombination through power combiner 82 at output 0 are in phase. The total drive level to the amplifiers 68 (the input to the power splitter 80) must be increased by a factor of n (n=2 in FIG. 9) plus the passive loss in the combiner and splitters to achieve the equality of drive to the final amplifiers which is a technique of this process, the prime objective being to increase the output power by a factor of n. The power applied at output 0 will be twice that which could be produced by a circuit using a single amplifier 68 alone. The power output can be modified to any integer value simply by changing the number of amplifiers 68 which are located between the power splitter 80 and the power combiner 82. All of the above described elements relating to FIG. 9 may be considered as a power amplification portion 86.

The output 0 of the power combiner 82 (also the power amplification portion 86) is input into a power splitting portion 87 which is identical (in structure and function) to the FIG. 6 configuration except for the replacement of the power amplification portion 86 for the amplifier 68. As such, similar reference characters are provided in the power splitting portion as in the FIG. 6 embodiment. In the manner described above with reference to FIG. 6, a circular polarization is produced in the radiating element 10 by the action of the power splitter portion 87 as driven by the power amplification portion 86.

General Considerations

In the above present invention embodiments, if the radiating element 10 is a horn, the signals produced by the driving portions (illustrated in FIGS. 5–9) combine in free space within the throat of the horn. If the radiating element 10 is a patch on a dielectric medium, then the signals combine in the dielectric between the probes and the element, or in the patch itself. A utilization of any well known radiation expelling device may be used as a radiating element 10 in the present invention.

In all the embodiments of the present invention, the amplifiers should be coupled directly to the probes such that the signals combine in free space in the horn or the dielectric media associated with patch arrays in the most efficient manner for coupling multiple amplifiers (since this minimizes the opportunity for unwanted loss). Also, even though the output signals of the radiating elements have been described as being circular in phase characteristics, it is within the scope of the present invention that the actual output is elliptical; and as such, any description in this specification of a circular phase pattern incorporates an elliptical phase pattern as well.

While the invention has been particularly shown and described with respect to preferred embodiments thereof, it will be understood by those skilled in the art that changes in form and details may be made therein without departing from the scope and spirit of the invention.

I claim:

1. A phased array transmitting antenna system for generating multiple amplitude tapered independent simultaneous microwave signal beams, comprising:

an array of antenna units, a plurality of said antenna units of said array comprising a plurality of substantially identical microwave power amplifiers and coupler means for imparting a predetermined phase shift between microwave signals output from said plurality of microwave power amplifiers for providing orthogonal microwave energy signals having selected phases;

each of said plurality of said antenna units of said array transmitting one of multiple, simultaneous microwave beams; and each of said plurality of said antenna units further comprising a radiating element responsive to said microwave signals output from individual ones said plurality of microwave power amplifiers for transmitting said microwave signals into space as a beam having a direction and shape, each of said individual ones of said plurality of microwave power amplifiers having an output coupled to a respective one of said radiating elements; wherein all of said plurality of microwave power amplifiers of said array operate with a same power level, wherein first selected ones of said plurality of antenna units radiate with a power level that is n times a power level of second selected ones of said plurality of antenna units for providing a predetermined amplitude taper across said array, wherein n is an integer that is greater than one, and wherein said first selected ones of said plurality of antenna units comprise one of said radiating elements that is coupled to the outputs of n of said microwave power amplifiers.

2. A phased array transmitting antenna system according to claim 1 wherein outputs of said plurality of microwave power amplifiers are coupled into a cavity, wherein said cavity includes a first pair of microwave probes disposed in said cavity 180 degrees apart, a second pair of probes disposed in said cavity 180 degrees apart, said first and second pairs of probes being disposed 90 degrees apart, a first pair of linear microwave power amplifiers connected to said first pair of probes and a second pair of linear microwave power amplifiers connected to said second pair of probes for exciting orthogonal microwave energy in said cavity.

3. A phased array transmitting antenna system according to claim 2 wherein said array is disposed over a surface of a substrate, wherein said substrate includes phase shift means and attenuator means connected to said first and second pairs of amplifiers and probes in said cavity for providing phase quadrature signals to create circular signal polarization wherein one of said pairs of amplifier and probes is excited to right circular polarization and the other of said pairs of amplifiers and probes is excited to left circular polarization.

4. A phased array transmitting antenna system according to claim 3 wherein said phase shift and attenuator means includes a plurality of separate phase shift and attenuator circuits, and a switch matrix connected to each of said phase shift and attenuator circuits to selectively connect separate polarization signals to said pairs of amplifiers and probes in said cavity, said separate polarization signals cooperating with said plurality of microwave power amplifiers for providing the direction and shape of said microwave beam.

5. A phased array transmitting antenna system according to claim 4 wherein said attenuator means are set to provide that said microwave beams transmitted from said radiating elements of said plurality of antenna units are equal to a multiple of a least amplitude of any microwave beam produced by any antenna unit in said array.

6. A phased array transmitting antenna system according to claim 5 further including a plurality of power signals and wherein said phase shift and attenuator circuits for each antenna unit includes a plurality of series connected phase shift and attenuator circuits, each of said plurality of series connected phase shift and attenuator circuits being connected to a separate power signal wherein each of said series connected phase shift and attenuator circuits is associated with a separate beam to be transmitted by said antenna unit, and wherein each of said series connected phase shift and attenuator circuits cooperates with said plurality of microwave power amplifiers for establishing the direction and shape for each associated beam.

7. A phase array transmitting antenna system according to claim 6 further including control means connected to each of said phase shift circuits and attenuator circuits for setting said phase shift circuit at selected values of phase shift to provide desired beam directions and shapes.

8. A phase array transmitting antenna system according to claim 1 wherein each of said microwave power amplifiers comprises a monolithic microwave integrated circuit amplifier.

9. An amplitude tapered phased array antenna, comprising an antenna array comprised of a plurality of substantially concentric zones, each of said zones comprising a plurality of discrete antenna radiating elements each supporting a substantially circularly polarized wavefront, each of said antenna radiating elements within a first, outer zone radiating microwave energy with a unit power level; said amplitude tapered phased array antenna further comprising at least one second, inner zone, each of said antenna radiating elements within said second, inner zone radiating microwave energy with a power level that is an integer multiple of said unit power level, wherein each antenna radiating element is coupled to an output of at least one microwave energy amplifier, wherein each microwave energy amplifier outputs microwave energy at said unit power level, and wherein individual ones of said antenna radiating elements of said at least one second, inner zone are coupled to outputs of an integer multiple more of said microwave energy amplifiers than individual ones of said antenna radiating elements of said first, outer zone.

10. An amplitude tapered phased array antenna, comprising an antenna array comprised of a plurality of substantially concentric zones, each of said zones comprising a plurality of discrete antenna radiating elements, each of said antenna radiating elements within a first, outer zone comprising a microwave power amplifier having an output and a phase shifter coupled to said output for providing a first output signal and a second output signal that is shifted in phase from said first output signal, said output signals being coupled to said radiating element, said microwave power amplifier being operated at a selected power level; said amplitude tapered phased array antenna further comprising at least one second, inner zone, each of said antenna radiating elements within said second, inner zone comprising at least two microwave power amplifiers each having an output providing an output signal to said radiating element that is shifted in phase with respect to said other output signal, each of said at least two microwave power amplifiers also being operated at said selected power level, whereby all microwave power amplifiers of said array are operated at a same power level.

11. An amplitude tapered phased array antenna, comprising an antenna array comprised of a plurality of substantially concentric zones, each of said zones comprising a plurality of discrete antenna radiating elements, each of said antenna radiating elements within a first, outer zone comprising a microwave power amplifier having an output and a phase shifter coupled to said output for providing a first output signal and a second output signal that is shifted in phase from said first output signal, said output signals being coupled to said radiating element, said microwave power amplifier being operated at a selected power level; said amplitude tapered phased array antenna further comprising a second zone that is surrounded by said first, outer zone, each of said antenna radiating elements within said second zone comprising two microwave power amplifiers each having an output providing an output signal to said radiating element that is shifted in phase with respect to said other output signal, each of said two microwave power amplifiers also being operated at said selected power level; said amplitude tapered phased array antenna further comprising a third zone that is surrounded by said second zone, each of said antenna radiating elements within said third zone comprising four microwave power amplifiers each having an output providing an output signal to said radiating element that is shifted in phase with respect to others of said output signals, each of said four microwave power amplifiers also being operated at said selected power level, wherein all microwave power amplifiers of said array are operated at a same power level, and wherein each of said antenna radiating elements of said second and third zones radiates microwave energy with a power level that is a multiple of the power level radiated by said antenna radiating elements of said first, outer zone.

* * * * *